US010384093B2

(12) United States Patent
Peloquin et al.

(10) Patent No.: US 10,384,093 B2
(45) Date of Patent: Aug. 20, 2019

(54) RESISTANCE KICKBOARD ATTACHMENT

(71) Applicants: TYR Sport, Inc., Farmingdale, NY (US); Raymond E. Peloquin, Washington, DC (US)

(72) Inventors: Eric Carlin Peloquin, Brooklyn, NY (US); Philip Moses Bayer, Brooklyn, NY (US); Matthew Vito DiLorenzo, New York, NY (US); Thomas Wenzler, East Northpoint, NY (US); Yang Wang, Syosset, NY (US)

(73) Assignee: TYR Sport, Inc., Farmingdale, NY (US)

( * ) Notice: Subject to any disclaimer, the term of this patent is extended or adjusted under 35 U.S.C. 154(b) by 38 days.

(21) Appl. No.: 15/632,630

(22) Filed: Jun. 26, 2017

(65) Prior Publication Data

US 2018/0369632 A1 Dec. 27, 2018

(51) Int. Cl.

| | |
|---|---|
| ***A63B 21/008*** | (2006.01) |
| ***A63B 31/10*** | (2006.01) |
| ***A63B 31/00*** | (2006.01) |
| *A63B 21/00* | (2006.01) |
| *A63B 23/035* | (2006.01) |
| *A63B 31/08* | (2006.01) |
| *A63B 31/12* | (2006.01) |

(52) U.S. Cl.

CPC ..... *A63B 21/0084* (2013.01); *A63B 31/00* (2013.01); *A63B 31/10* (2013.01); *A63B 21/00058* (2013.01); *A63B 23/035* (2013.01); *A63B 23/03516* (2013.01); *A63B 31/08* (2013.01); *A63B 31/12* (2013.01)

(58) Field of Classification Search

CPC ..... A63B 21/0058; A63B 23/035; A63B 23/03516; A63B 31/00; A63B 31/10; A63B 31/12; A63B 31/08; A63B 31/02; A63B 31/04; A63B 31/11; A63B 31/14; A63B 31/18; A63B 2031/112; A63B 2031/115; A63B 2031/117

See application file for complete search history.

(56) References Cited

U.S. PATENT DOCUMENTS

| | | | | |
|---|---|---|---|---|
| 3,517,930 | A * | 6/1970 | Jacobsen ..... | A63B 21/0084 482/55 |
| 3,584,870 | A | 6/1971 | Garst | |
| 5,011,137 | A | 4/1991 | Murphy et al. | |
| 5,385,421 | A | 1/1995 | Morgan et al. | |
| 5,472,391 | A | 12/1995 | Weissbuch et al. | |
| 6,955,577 | B1 | 10/2005 | Hall | |
| 7,597,601 | B2 | 10/2009 | Mravca | |
| 9,050,489 | B2 | 6/2015 | Bell | |

(Continued)

*Primary Examiner* — Megan Anderson

(74) *Attorney, Agent, or Firm* — Stetina Brunda Garred & Brucker

(57) ABSTRACT

A resistance kickboard attachment is disclosed. When attached to a kickboard, the resistance kickboard attachment adds resistance while swimming with the kickboard. The resistance kickboard attachment includes a resistance pocket, with variable resistance provided by an adjustment of a rear aperture of the resistance pocket. The resistance kickboard attachment attaches to the kickboard with a transverse and a longitudinal strap. The transverse strap includes an adjustment on either side of the longitudinal strap which allows the longitudinal strap to be centered on the kickboard.

15 Claims, 2 Drawing Sheets

(56) References Cited

U.S. PATENT DOCUMENTS

| | | | | |
|---|---|---|---|---|
| 9,072,955 | B2 | 7/2015 | King | |
| 9,193,419 | B2 | 11/2015 | Haldeman | |
| 9,943,726 | B2 * | 4/2018 | Tilson | A63B 31/04 |
| 2008/0161167 | A1 * | 7/2008 | Ottaviani | A63B 69/12 482/55 |
| 2012/0225599 | A1 | 9/2012 | Koersen | |

* cited by examiner

RESISTANCE KICKBOARD ATTACHMENT

CROSS-REFERENCE TO RELATED APPLICATIONS

Not Applicable

STATEMENT RE: FEDERALLY SPONSORED RESEARCH/DEVELOPMENT

Not Applicable

BACKGROUND

Kickboards have long been used for swim training. When using a kickboard, a swimmer may isolate the kick portion of the swimming stroke. More generally, swimmers use resistance devices to increase difficulty during training in order to improve competitive performance.

A drawback common to many prior art techniques for creating additional resistance or drag is that they do not permit the swimmer to isolate and train the muscles used in kicking. Kicking is a vitally important part of competitive swimming. Swimmers obtain much of their overall swimming power and speed from kicking. It is well recognized that isolating and training the muscles used in kicking strengthens the muscles used in kicking and allows the swimmer to concentrate on the muscle movements used in their kicking stroke, thereby increasing the endurance and power of the swimmer's kicking stroke and the swimmer's overall swimming speed.

Some prior art devices have addressed the need for a kickboard mounted device to increase drag. However, these devices were integrated in to a specific kickboard such that a user would have to carry that kickboard to a training session. The devices were rigid and not of a flexible material which could be compacted by folding or other methods and placed in a bag, and then removed to be set up at the pool for a training session. Obvious, as integrated devices, these prior art aids did not address the fact that swimmers may train at various sites that may have different kickboards already available, and the only need is for the drag component to be added.

BRIEF SUMMARY

A resistance kickboard attachment may be used to isolate the kick portion of the swimming stroke and may be used to add resistance while swimming with the kickboard. The resistance kickboard attachment may include a resistance pocket. The resistance pocket may include a mouth. The mouth may be held open by a resilient body. The resistance pocket may provide variable resistance. The variable resistance may be provided by an adjustment of a rear aperture of the resistance pocket. The resistance kickboard attachment may attach to the kickboard with a transverse and a longitudinal strap. The transverse strap includes an adjustment on either side of the longitudinal strap which allows the longitudinal strap to be centered on the kickboard.

Specifically, a device for attaching to a kickboard to increase water resistance during swimming is disclosed. The device may include a resistance pocket including a first opening on a front end. The first opening may include a resilient body, and a second opening on a back end of the resistance pocket. The second opening may include an adjustment band which may move the opening from a fully open position to a plurality of more constricted positions.

A longitudinal strap may include a first section connected to the resistance pocket front end, and a second section connected to the rear end of the resistance pocket. The longitudinal strap may further include a connecter which connects the first and second seconds.

A transverse strap may be connected to the resistance pocket and may be connected the longitudinal strap. the transverse strap may include a center section. The center section may include an adjustment fitting on both ends. The transverse strap may further include a first side section, which may be attached on one end to the resistance pocket and, on an opposite end, adjustably attached to the corresponding adjustment fitting on the center section. The transverse strap may further include a second side section. The second side section may be attached on one end to the opposite side of the resistance pocket from the first section, and, on an opposite end, may be adjustably attached to the corresponding adjustment fitting on the center section. The first side section and second side section may be shortened and lengthened using the corresponding adjustment fitting to center the longitudinal strap on the kickboard.

Further disclosed may be a device for attaching to a kickboard to increase water resistance during swimming. The device may comprise a resistance pocket. The resistance pocket may include a resilient body in a first channel on a front end, and a locking adjustment strap in a second channel on a back end.

The device may further include two straps. The device may include a longitudinal strap attached on a first end to the front end of the resistance pocket, and may further attach on a second end to a back end of the resistance pocket. The device may also include a transverse strap connected to the resistance pocket and the longitudinal strap. The transverse strap may include a plurality of adjustment fittings. The transverse strap may also include a first side section attached on one end to the resistance pocket and, on an opposite end, adjustably attached to one of the plurality of adjustment fittings. Finally, the transverse strap may include a second side section attached on one end to the opposite side of the resistance pocket from the first section, and, on an opposite end, adjustably attached to one of the plurality of adjustment fittings. The first side section and second side section may be shortened and lengthened using the plurality of adjustment fittings to center the longitudinal strap on the kickboard.

Also disclosed is a method of manufacturing a swim training device for attaching to a kickboard. The method may comprise providing a resilient body. The resilient body may include a flat section and an arcuate section. The method may further include attaching a resistance pocket to the resilient body. The resistance pocket may include a waterproof material, a first opening connected to the resilient body, and a second opening including an adjustment strap. The method may further include connecting a first section of a longitudinal strap to a first portion of the first opening.

A second section of a longitudinal strap may be connected to a portion of the second opening.

A first end of a first side section of a transverse strap may be connected to a second portion of the first opening, and a second end of the first side section may be connected to a first adjustment fitting. The method may also include connecting a first end of a second side section of the transverse strap to a third portion of the first opening, and the method may also include a second end of the second side section to a second adjustment fitting. Finally, the longitudinal and transverse straps may be connected.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
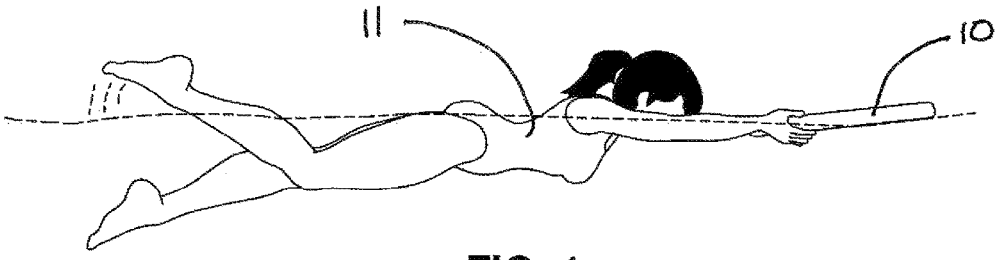
FIG. 1 shows a side view of a swimmer using a standard kickboard.
Figure 2:
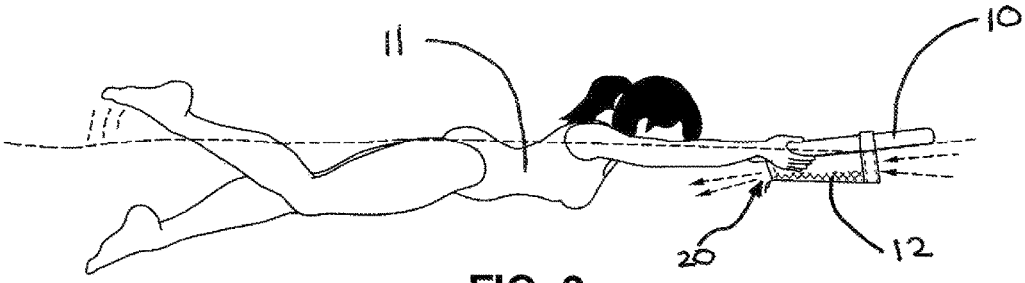
FIG. 2 shows a side view of a swimmer using a kickboard with the resistance kickboard attachment.
Figure 3:
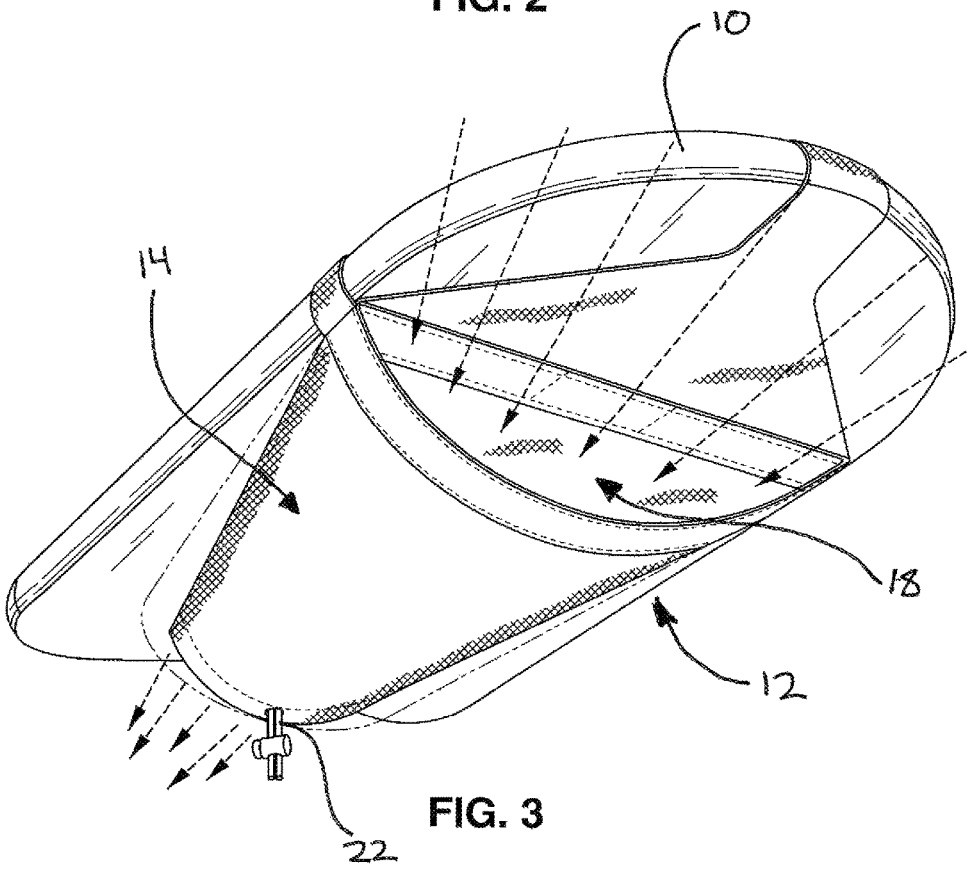
FIG. 3 shows a perspective view of the resistance kickboard attachment mounted to a kickboard.

The disclosed device is a swim training aid which may be attached to most kickboards produced today. As shown in FIG. 1, swimmers 11, use kickboards 10 to isolate the kick portion of their stroke during swim training. As shown in FIGS. 2 and 3, the resistance kickboard attachment 12 may be attached to the kickboard 10. The resistance kickboard attachment 12 may increase drag by locating a resistance pocket 14 on the underside 16 of the kickboard 10. As shown in FIG. 3 alone, the resistance pocket 14 may have a tapered shape, causing water, which is indicated by the arrows in FIG. 3, entering a mouth 18 of the resistance pocket 14 to travel from a greater volume to a smaller volume, thereby increasing pressure of the water and producing drag on the swimmer 11 using the kickboard 10. The water in the resistance pocket 14 may exit the resistance pocket 14 through a rear aperture 20. The rear aperture 20 may include an adjustment strap 22. The drag may be further increased by adjusting the adjustment strap 22 from a greater to a smaller length, thereby constricting the rear aperture 20.

Figure 4:
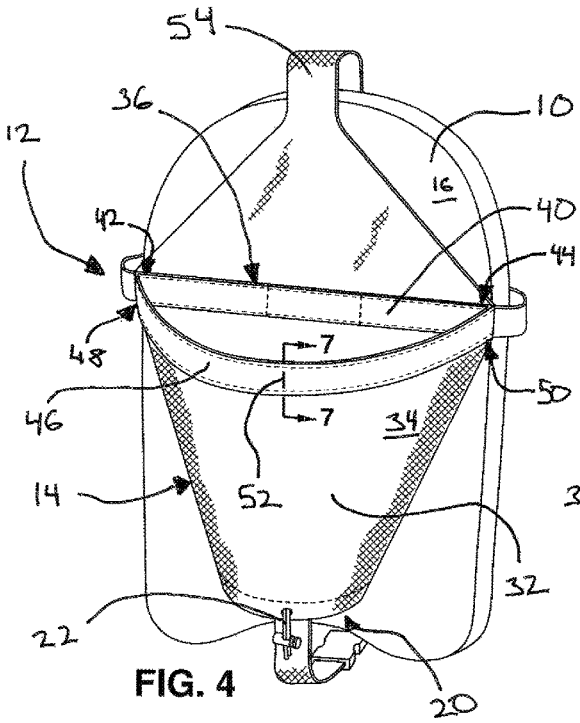
FIG. 4 shows a perspective view of the underside of a kickboard during the mounting of the resistance kickboard attachment.

As shown in FIGS. 3-6, a longitudinal strap 24 and a transverse strap 26 may be connected to the resistance pocket 14. The longitudinal strap 24 and the transverse strap 26 may be used to attach the resistance kickboard attachment 12 to the kickboard 10. The longitudinal strap 24 and transverse strap 26 may be connected. The longitudinal strap 24 may include a fastener 28. The transverse strap 26 may include an adjustment fitting 30 on either side of the longitudinal strap 24. The adjustment fittings 30 allow the section of the transverse strap 24 on either side to be lengthened or shortened to center the longitudinal strap 24 on the kickboard 10. Referring to FIG. 4, the resistance kickboard attachment 12 may include a resistance pocket 14. A resistance pocket body 32 may be formed of a flexible, waterproof material 34. The resistance pocket 14 may include a first opening or mouth 18, and a second opening or rear aperture 20. The resistance pocket body 32 may extend between the first and second openings 18, 20. The resistance pocket 14 may taper from the larger first opening 18 to the smaller second opening 20. The taper may form the resistance pocket 14 in a semi funnel shape.

Figure 7:
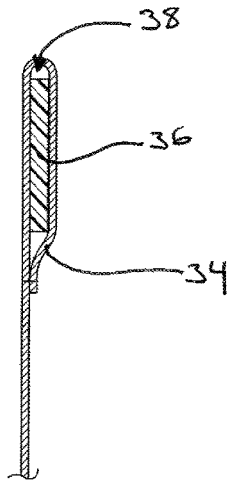
FIG. 7 shows a cross sectional view of a portion of the resilient body and waterproof material at line 7-7 of FIG. 4.

The first opening or mouth 18 may include a resilient body 36 with two sections. As shown in FIG. 7, which is a cross section of the resilient body 36 and resistance pocket material 34 taken at Line 7-7 in FIG. 4, the resilient body 36 may be located in an enclosed channel 38 formed from the waterproof material 34. A first resilient body section 40 may be flat. The first resilient body section 40 may be located adjacent to the underside 16 of the kickboard 10. The first resilient body section 40 may include a first end 42 and a second end 44. A second resilient body section 46 may have an arcuate shape. The second resilient body section 46 may include a first end 48 and a second end 50. The first end 48 of the second resilient body section 46 may be connected to the first end 42 of the first resilient body section 40. The second end 50 of the second resilient body section 46 may be connected to the second end 44 of the first resilient body section 40. From each end, the second resilient body section 46 may extend away from the first resilient body section 40 to a point 52 furthest away from the first resilient body section 40. The point 52 furthest away from the first resilient body section 40 may be substantially in the center of the second resilient body section 46. The two resilient body sections 40, 46 taken together may form a half ellipse. The resilient body 36 may hold the mouth 18 of the resistance pocket 14 open. Without the resilient body 36, it is likely the water pressure would collapse the mouth 18 of the resistance pocket 14, rendering the resistance pocket 14 non-functional. Instead the resilient body 36 may keep the mouth 18 open, and the pressure created by the water inside the resistance pocket 14 may keep the resistance pocket 14 filled out to a semi-funnel shape.

As also shown in FIG. 4, the resistance pocket 14 includes a second end 20. The second end 20 may also be called a rear aperture 20. The rear aperture 20 may be adjusted in size. The rear aperture 20 may include an adjustment strap 22. Similar to the resilient body 36, the adjustment strap 22 may be encased in the waterproof material 34 of the resistance pocket body 32. By way of example and not limitation, in order to form the enclosed channel 38 which encases the adjustment strap 22, the material of the resistance pocket body 32 may be folded over and sewn back on to itself. By way of example and not limitation, the adjustment strap 22 may be a drawstring with a locking attachment, or may be a belt with different points of adjustment and a buckle, or a hook and loop fastener. The rear aperture 20 opening may be smaller than the mouth 18, even when adjusted to the maximum opening possible. As is indicated by the dotted line in FIG. 3, the rear aperture 20 may be moved from a fully open position to a plurality of more constricted positions. The dotted line may indicate the maximum opening of the rear aperture 20, and the position of the rear aperture 20 in solid lines may indicate one of the plurality of more constricted positions. Each of the more constricted positions may create more drag than the fully open position. Drag may increase as the positions become increasingly constricted.

Figure 5:
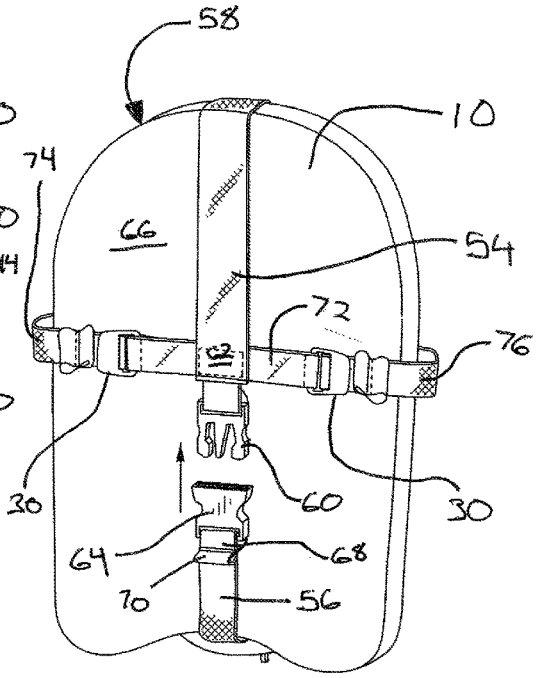
FIG. 5 shows a perspective view of the top side of a kickboard during the mounting of the resistance kickboard attachment.
Figure 6:
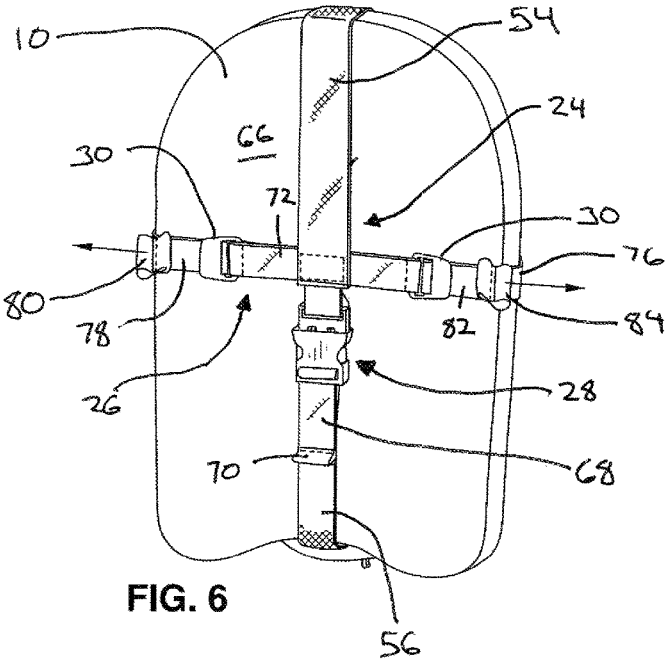
FIG. 6 shows a perspective view of the final attachment and adjustment of the resistance kickboard attachment when mount the attachment to a kickboard.

As shown in FIGS. 4-6, the resistance kickboard attachment 12 may further include two straps. The two straps may be one longitudinal strap 24 and one transverse strap 26. The resistance kickboard attachment 12 may include additional straps. By way of example and not limitation, the resistance kickboard attachment 12 may include additional longitudinal straps, or additional transverse straps, or may include diagonal straps. The transverse strap 26 and the longitudinal strap 24 may be configured so that the transverse strap 26 is connected to the longitudinal strap 24. By way of example and not limitation, the transverse strap 26 and the longitudinal strap 24 may be connected by sewing one strap to the other, or by using a hook and loop fastener to connect the two straps, or by using a mechanical fastener, such as a button, to connect the two straps. Because the transverse 26 and longitudinal 24 straps may be connected, the resistance kickboard attachment 12 may one only one fastener 28 to attach the device to the kickboard 10. The fastener 28 may be on the longitudinal strap 24. By way of example, and lot limitation, the fastener 28 may be fastex brand style connector, or a hook and loop fastener, or a snap.

As shown in FIGS. 4-6, the resistance kickboard attachment 12 may include a longitudinal strap 24. The longitudinal strap 24 may have two sections. A first or forward section 54 may be connected to the resistance pocket body waterproof material 34 encasing the flat section 40 of the resilient body 36. As shown in FIG. 4, the connection may be along an entirety of the length of the flat section 40 of the resilient body 36. Alternatively, the connection may be along only a portion of the length of the flat section 40 of the resilient body 36. By way of example and not limitation, the first section 54 of the longitudinal strap 24 may be connected by sewing, by adhesive, by a hook and loop fastener, or by a plurality of mechanical fasteners, or any other connector which securely attaches the first section 54 of the longitudinal strap 24 to the resistance pocket body 32. The first section 54 may taper from a wide point at the connection to the resistance pocket body 32 to a more narrow portion of the first section 54 which wraps around a front end 58 of the kickboard 10. The first section 54 may then continue along until the first section 54 crosses the transverse strap 26, where the transverse 26 and longitudinal 24 straps may connect as described above. The forward section 54 may have a male fastener portion 60 extending beyond the connection point 62. Alternatively, the forward section 54 may have a female fastener portion 64 extending beyond the connection point 62, or the fastener 28 may be on the connection point 62, or the fastener 28 may be forward of the connection point 62.

The longitudinal strap 24 may have a second section 56. The second section 56 may connect on one end to the resistance pocket body 32 near the rear aperture 20. The second section 56 may be configured to wrap around the kickboard 10 from the underside 16 of the kickboard 10 to the top surface 66 of the kickboard 12. The second end of the second section 56 may include a connector component 60, 64 to connect the second 56 and first sections 54 of the longitudinal strap 24. The second section 56 may further include an adjustment portion 68 which may extend beyond the fastener 28. The adjustment portion 68 of the second section 56 may extend beyond the fastener 28 and may allow the user to adjust a length of the longitudinal strap 24. The adjustment portion 68 of the second section 56 which extends beyond the fastener 28 may include a pull tab 70. The adjustment portion 68 of the second section 56 which extends beyond the fastener 28 may be woven through the fastener 28 to allow for adjustment of the second section 56.

As shown in FIGS. 4-6 the resistance kickboard device 12 further includes a transverse strap 26. The transverse strap 26 may include three sections, a central section 72, and a first side section 74, and a second side section 76. The central section 72 may be connected to the longitudinal strap 24. The central section 72 may have an adjustment fitting 30 attached to either end. By way of example and not limitation, the adjustment fitting 30 may be a ladder lock or similar component. The adjustment fitting 30 may be attached by sewing a loop around a portion of the adjustment fitting 30, or may be attached in any other manner which holds the ladder lock 30 securely to either end of the center section 72.

The transverse strap 26 may further include a first side section 74. The first side section 74 may connect to the resistance pocket 14 at the conjunction of the first end 42 of the flat section 40 of the resilient body 36, and the first end 48 of the arcuate section 46 of the resilient body 36. By way of example and not limitation, the first section 74 of the transverse strap 26 may be connected by sewing, or adhesive, or a hook and loop fastener, or any other connection means which holds the first side section 74 securely to the resistance pocket 14. The first side section 74 may be connected to the center section 72 at an end of the first side section 72 opposite the end of the first side section 72 which connects to the resistance pocket 14. By way of example and not limitation, the first side section 74 may be connected to the center section 72 by weaving an end 78 of the first side section 74 through an adjustment fitting 30, for example, a ladder lock. Once the end 78 may be woven through the adjustment fitting 30, a tip of the end 78 may be folded back on it the end 78 of the first side section 74 and may be sewn back to the first side section 74 in order to form a pull tab 80. The pull tab 80 may aid a user in adjusting the first side section 74 by providing additional grip on the first side section 74 for a user.

The transverse strap 26 may further include a second side section 76, which mirrors the first side section 74. The second side section 76 may connect, on a first end, to the resistance pocket 14 at the conjunction of the second end 44 of the flat section 40 of the resilient body 36, and the second end 50 of the arcuate section 46 of the resilient body 36. An opposite end 82 of the second side section 76 connects to an adjustment fitting 30 on the opposite end of the center section 72 from where the first side section 74 connects. Similar to the first side section 74, by way of example and not limitation, the second side section 76 may be connected to the center section 72 by weaving the end 82 of the second side section 76 through an adjustment fitting 30. Once the end 82 may be woven through the adjustment fitting 30, a tip of the end 82 may be folded back on the end 82 and may be sewn back to the end 82 in order to form a pull tab 84. The pull tab 84 may aid a user in adjusting the second side section 76 by providing additional grip on the second side section 76 for a user. Alternatively, the pull tab 80, 84 on either the first or second side sections 74, 76 may be formed by sewing a tab of a different material to the strap, or the pull tab may be formed by a combination of sewing the side section back on to itself, and sewing in a different material. By way of example and not limitation, a resilient material may be sewn in to a pocket created by sewing the strap back on to itself.

With reference to FIGS. 2-6, in operation, the resistance kickboard attachment 12 may be first attached to a kickboard 10. The resistance kickboard attachment 12 is designed to be universal, meaning that the resistance kickboard attachment 12 will attach to, and function properly on, most known kickboard 10 designs. In order to attach the resistance kickboard attachment 12 to a kickboard 10, a front portion of the kickboard 10 may be placed in the first section 54 of the longitudinal strap 24 and the transverse strap 26 of the kickboard resistance attachment 12. The first section 54 of the longitudinal strap 24 and the connected transverse strap 26 may form a webbed basket 86. The front portion of the kickboard 10 may be placed in this webbed basket 86. The kickboard 10 may be placed in the webbed basket 86 such that the resistance pocket 14 may be on the underside 16 of the kickboard 10, and the fastener 28, and the adjustment fittings 30 may be on the top surface 66 of the kickboard 10.

The second section 56 of the longitudinal strap 24 may then be wrapped around the rear of the kickboard 10 and the portion 60, 64 of the fastener on the second section 56 of the longitudinal strap 24 connected to the portion 60, 64 of the connector on the first section 54 (as indicated by the arrow in FIG. 5). The pull tab 70 on the second section 56 of the longitudinal strap 24 may be used to tighten the longitudinal strap 24 in order to secure the kickboard resistance device 12 on the kickboard 10 longitudinal axis.

Once the kickboard resistance device 12 is attached to the kickboard 10, the kickboard resistance device 12 may be adjusted on the kickboard 10. As described above, the first side section 74 and second side section 76 may include adjustment fittings 30. The first side section 74 and second side section 76, attached to their corresponding adjustment fittings 30, may be loosened or tightened by pulling on the pull tabs 80, 84 (as indicated by the arrows in FIG. 6) and working the adjustment fitting 30 until the longitudinal strap 24 is centered on the kickboard 10. The Centering the longitudinal strap 24 on the kickboard 10 may ensure that the resistance pocket 14 on the underside 16 of the kickboard 10. Centering the resistance pocket 14 may prevent the kickboard 10 from pulling to one side or the other while the user is swimming.

Next, the adjustment strap 22 on the rear aperture 20 may be tightened or loosened in order to create the proper opening to provide the corresponding resistance or drag the user wishes for that swim training session. With the kickboard resistance attachment 12 adjusted on the kickboard 10, the combination kickboard 10 and attachment 12 are ready for swim training.

The above description is given by way of example, and not limitation. Given the above disclosure, one skilled in the art could devise variations that are within the scope and spirit of the invention disclosed herein, including various ways of centering the device on the kickboard. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A device for attaching to a kickboard to increase water resistance during swimming, the device comprising:

a resistance pocket including a first opening on a front end, the first opening including a resilient body, and a second opening on a back end of the resistance pocket, the second opening including an adjustment band which moves the second opening from a fully open position to a plurality of more constricted positions;

a longitudinal strap including a first section connected to the front end of the resistance pocket, a second section connected to the back end of the resistance pocket, and a connector which connects the first section and second section;

a transverse strap connected to the resistance pocket and the longitudinal strap, the transverse strap including:

a center section including a first end and a second end, each of the first and second ends having an adjustment fitting;

a first side section attached on one end to the resistance pocket and, on an opposite end, adjustably attached to one of the adjustment fittings on the center section; and a second side section attached on one end to the opposite side of the resistance pocket from the first section, and, on an opposite end, adjustably attached to the other of the adjustment fittings on the center section;

wherein the first side section and second side section are shortened and lengthened using the adjustment fittings to center the longitudinal strap on the kickboard.

2. The device of claim 1, wherein the adjustment fittings are ladder locks.

3. The device of claim 1, wherein the adjustment band is a drawstring with a cord lock.

4. The device of claim 1, wherein a mouth of the first opening forms a half ellipse.

5. The device of claim 1, wherein the resistance pocket forms a semi-funnel shape.

6. The device of claim 1, wherein the longitudinal strap is sewn to the transverse strap.

7. The device of claim 1, wherein the resilient body includes a flat section and an arcuate section.

8. A device for attaching to a kickboard to increase water resistance during swimming, the device comprising:

a resistance pocket including:

a resilient body in a first channel on a front end of the resistance pocket; and a locking adjustment strap in a second channel on a back end of the resistance pocket;

a longitudinal strap attached on a first end to the front end of the resistance pocket, and a second end to the back end of the resistance pocket;

a transverse strap connected to the resistance pocket, including:

a center section include a plurality of adjustment fittings;

a first side section attached on one end to the resistance pocket and, on an opposite end, adjustably attached to a first one of the plurality of adjustment fittings; and a second side section attached on one end to the opposite side of the resistance pocket from the first section, and, on an opposite end, adjustably attached to a second one of the plurality of adjustment fittings;

wherein the first side section and second side section are shortened and lengthened using the plurality of adjustment fittings to center the longitudinal strap on the kickboard.

9. The device of claim 8, wherein the longitudinal strap includes a first section and a second section.

10. The device of claim 9, wherein the first section is connected to the transverse strap.

11. The device of claim 8, wherein the resilient body includes a flat section and an arcuate section.

12. The device of claim 8, wherein the plurality of adjustment fittings are ladder locks.

13. The device of claim 8, wherein the resilient body has a half elliptical shape.

14. The device of claim 8, wherein the locking adjustment strap includes a drawstring and cord lock.

15. The device of claim 8, wherein the resistance body creates a semi-funnel shape.

* * * * *